US007534397B2

(12) United States Patent
Dumitrescu

(10) Patent No.: US 7,534,397 B2
(45) Date of Patent: May 19, 2009

(54) SAMPLE PREPARATION DEVICE

(76) Inventor: Nicolae Dumitrescu, 44 Strawberry Hill Ave., Stamford, CT (US) 06902

( * ) Notice: Subject to any disclaimer, the term of this patent is extended or adjusted under 35 U.S.C. 154(b) by 0 days.

(21) Appl. No.: 11/608,472

(22) Filed: Dec. 8, 2006

(65) Prior Publication Data

US 2008/0138251 A1 Jun. 12, 2008

(51) Int. Cl.
*B01L 3/00* (2006.01)

(52) U.S. Cl. ..... 422/102; 422/198

(58) Field of Classification Search ..... 422/198, 422/102

See application file for complete search history.

(56) References Cited

U.S. PATENT DOCUMENTS 4,197,735 A 4/1980 Munzer et al.
4,663,127 A 5/1987 Jackson et al.
4,675,299 A 6/1987 Witty et al.
4,948,564 A 8/1990 Root et al.
5,855,852 A 1/1999 Bienhaus et al.
6,471,069 B2 10/2002 Linn et al.
6,740,240 B2 5/2004 Coville
2005/0238540 A1 * 10/2005 Swon et al. ..... 422/99

FOREIGN PATENT DOCUMENTS

DE 3505783 A1 8/1986
GB 2179447 A 3/1987

* cited by examiner

*Primary Examiner*—Walter D Griffin
*Assistant Examiner*—Natasha Young

(57) ABSTRACT

The sample preparation device includes a vessel, such as a sample tube, having a bottom end with a bottom opening. A valve for control of the flow of any liquid outwardly of the vessel through the bottom opening is located at the bottom end of the vessel. The valve includes a deflectable membrane positioned against the bottom opening to close the bottom opening when the valve is in its normally closed condition. The membrane is deflectable away from the bottom opening when the valve is in an open condition to permit any liquid in the vessel to flow through the bottom opening to an outlet port of the valve for dispensation into a suitable collection vessel.

20 Claims, 5 Drawing Sheets

SAMPLE PREPARATION DEVICE

FIELD OF THE INVENTION

This invention relates to devices and methods for removing liquid from a vessel for isolating and purifying a biological sample and for testing the biological sample. More particularly the invention relates to isolating and purifying nucleic acid contained in a biological sample and for testing the biological sample, such as by polymerase chain reaction (PCR) testing. More specifically, the invention relates to a device and method for removing liquid from a vessel without an aspiration device, thereby eliminating the possibility of carryover from an aspiration device.

BACKGROUND OF THE INVENTION

A PCR testing requires nucleic acid isolation/purification. In this process the nucleic acid solids from the biological sample are magnetically captured and then suspended in elution buffer solution. The purified end product is then transferred in a multi-vessel thermal cycler for PCR testing. During the isolation/purification process the nucleic acid from the biological material is bound to magnetic particles. The process requires several wash cycles of magnetic particles wash where the wash solution is discarded after each wash cycle. The magnetic particles plus the nucleic acid complexes are then eluted with an aqueous buffer. The eluted solution is transferred to the PCR testing vessel.

Recovery of the washed magnetic particles can be accomplished by removing the wash liquid from the wash vessel, usually with an aspiration probe. If the aspiration probe is used for aspirating other wash liquids from other wash vessels there is a risk of carryover from one wash vessel to another, and possible attraction of such carryover material to the cleansed magnetic particles.

One way of dealing with the carryover problem is to change the aspiration probe each time that sample or other liquid ingredient is aspirated from a sample tube or other liquid holding vessel. The changing of probes every time an aspiration is performed can be an expensive and time-consuming process.

Another way of dealing with the carryover problem is to wash any residue off the probe after each aspiration, before introducing the same probe into another sample tube or liquid holding vessel. The wash process is also time consuming and expensive.

It is thus desirable to remove liquid from a sample tube or other vessel, without using an aspiration device that makes physical contact with the liquid in a liquid-holding vessel. It is also desirable to substantially eliminate the carryover that is attributable to use of a common aspiration probe in different sample tubes or liquid holding vessels.

Transfer of the diluted solution to the PCR testing vessel without carryover is an important feature of the present invention.

DESCRIPTION OF THE DRAWINGS

In the accompanying drawings.

Corresponding reference numbers indicate corresponding parts throughout the several views of the drawings.

DETAILED DESCRIPTION OF THE INVENTION

Figure 1:
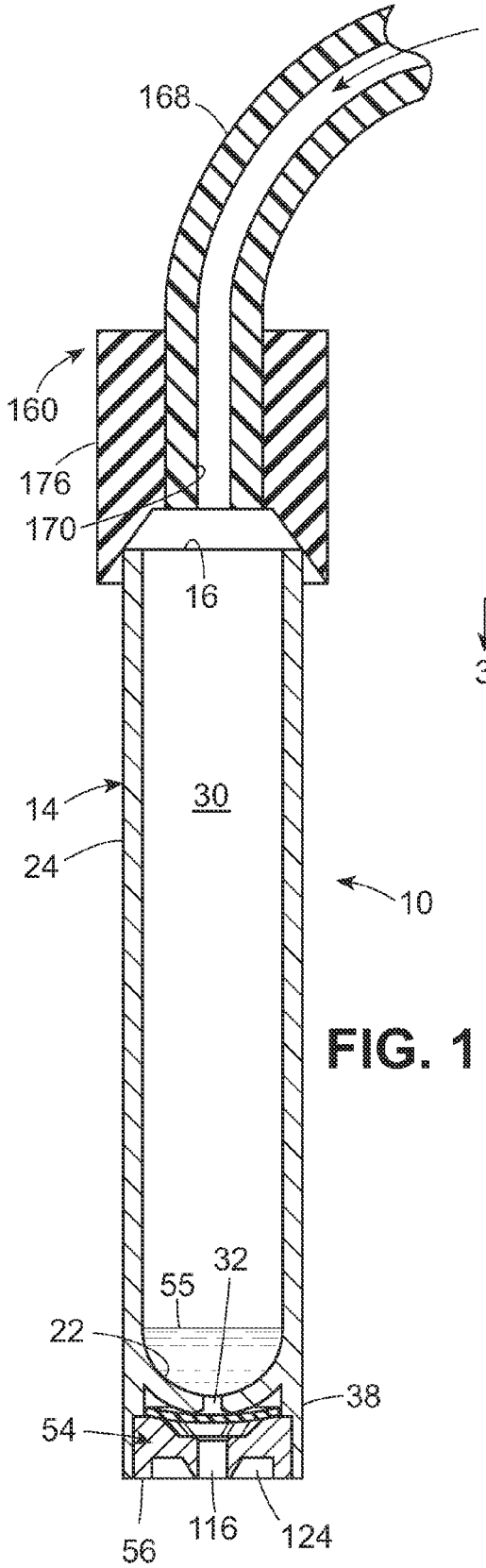
FIG. 1 is a simplified cross-sectional view of a sample preparation tube incorporating one embodiment of the invention in combination with a pressurizing device.
Figure 2:
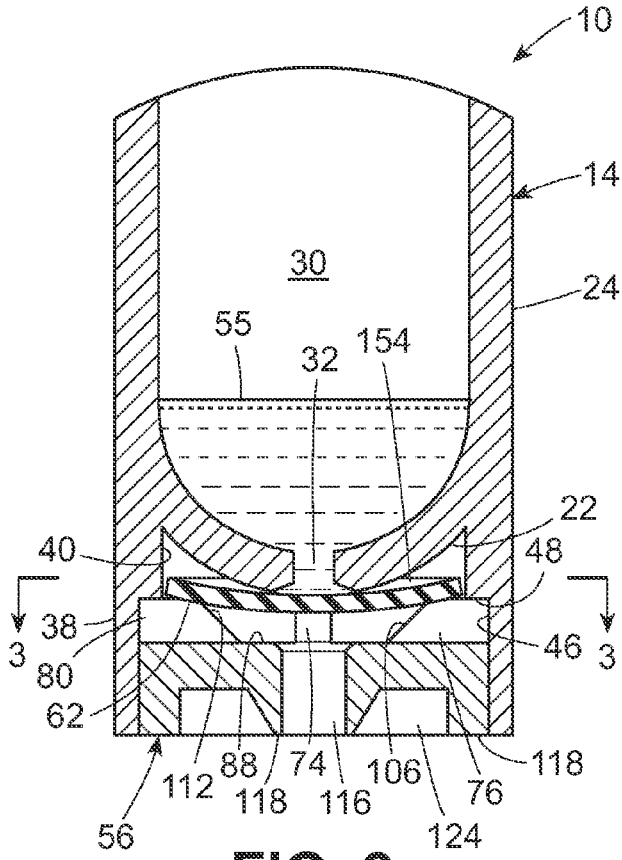
FIG. 2 is an enlarged fragmentary sectional view thereof, wherein a control valve is in a closed condition.

Referring to the drawings, a preferred embodiment of the invention is generally indicated by a sample preparation device 10 in FIG. 1.

The sample preparation device 10 includes a generally tubular vessel portion 14 having an upper open end 16 (FIG. 1), a bottom end 22 and a vessel wall 24 extending between the open end 16 and the bottom end 22. A liquid receiving space 30 is defined between the open end 16 and the bottom end 22. The bottom end 22 is substantially hemispherical in shape.

The vessel portion 14 can be formed of any suitable material such as plastic, preferably a transparent plastic such as polystyrene.

Figure 7:
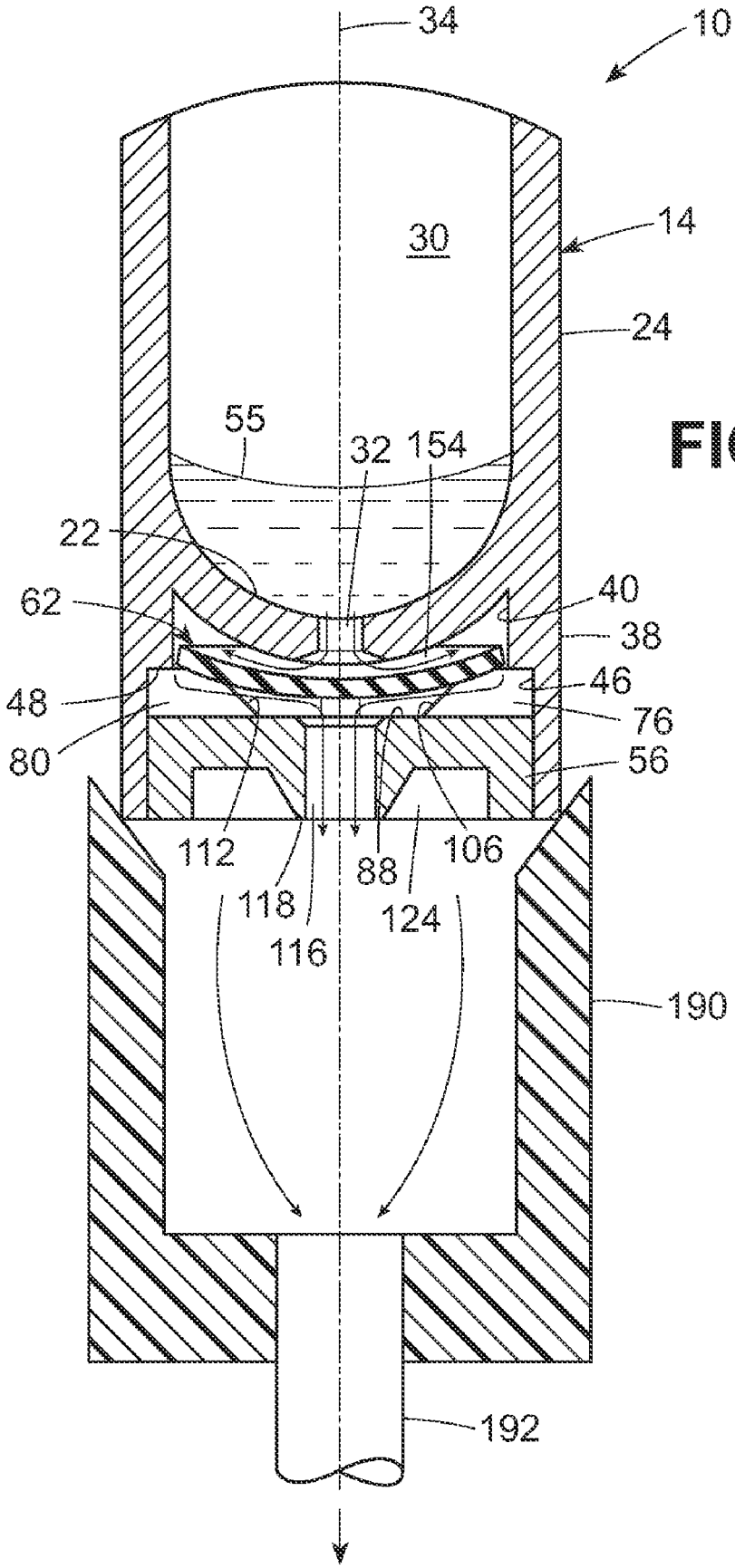
FIG. 7 is a sectional view thereof, similar to FIG. 5, in combination with a funnel device.

The bottom end 22 of the vessel portion 14 includes an opening 32 that is substantially coaxial with a central axis 34 (FIG. 7) of the vessel portion 14. An annular collar 38 is formed at the bottom end 22 of the vessel portion 14 as an extension of the vessel wall 24.

The annular collar 38 has an inside stepped surface that includes a first cylindrical surface portion 40 and a second cylindrical surface portion 46 of greater diameter than the first cylindrical surface portion 40. The cylindrical surface portions 40 and 46 are substantially concentric with the vessel wall 24. An annular step 48 extends between the first and second cylindrical surface portions 40 and 46, and is perpendicular to the surface portions 40 and 46.

A valve 54 (FIGS. 4 and 6) is provided at the bottom end 22 of the vessel portion 40 within the confines of the annular collar 38 for controlling the flow of any liquid, such as the liquid 55 in the liquid receiving space 30, through the bottom opening 32.

The valve 54 includes a generally cylindrical non-movable member 56 and a deflectable membrane 62. The deflectable membrane 62 is formed of any suitable, compressible and deflectable material such as Viton® fluoroelastomer made by Dupont. The deflectable membrane 62 is positioned between the bottom end 22 of the vessel portion 14 and a top end 64 (FIGS. 4 and 6) of the non-movable member 56.

Figure 3:
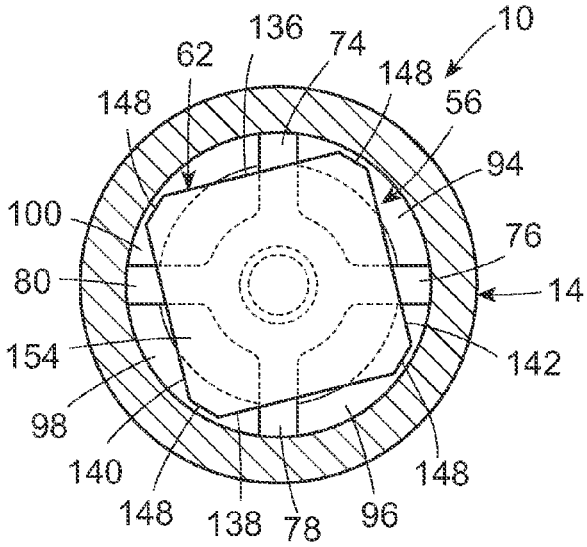
FIG. 3 is a sectional view taken along the line 3-3 of FIG. 2.
Figure 4:
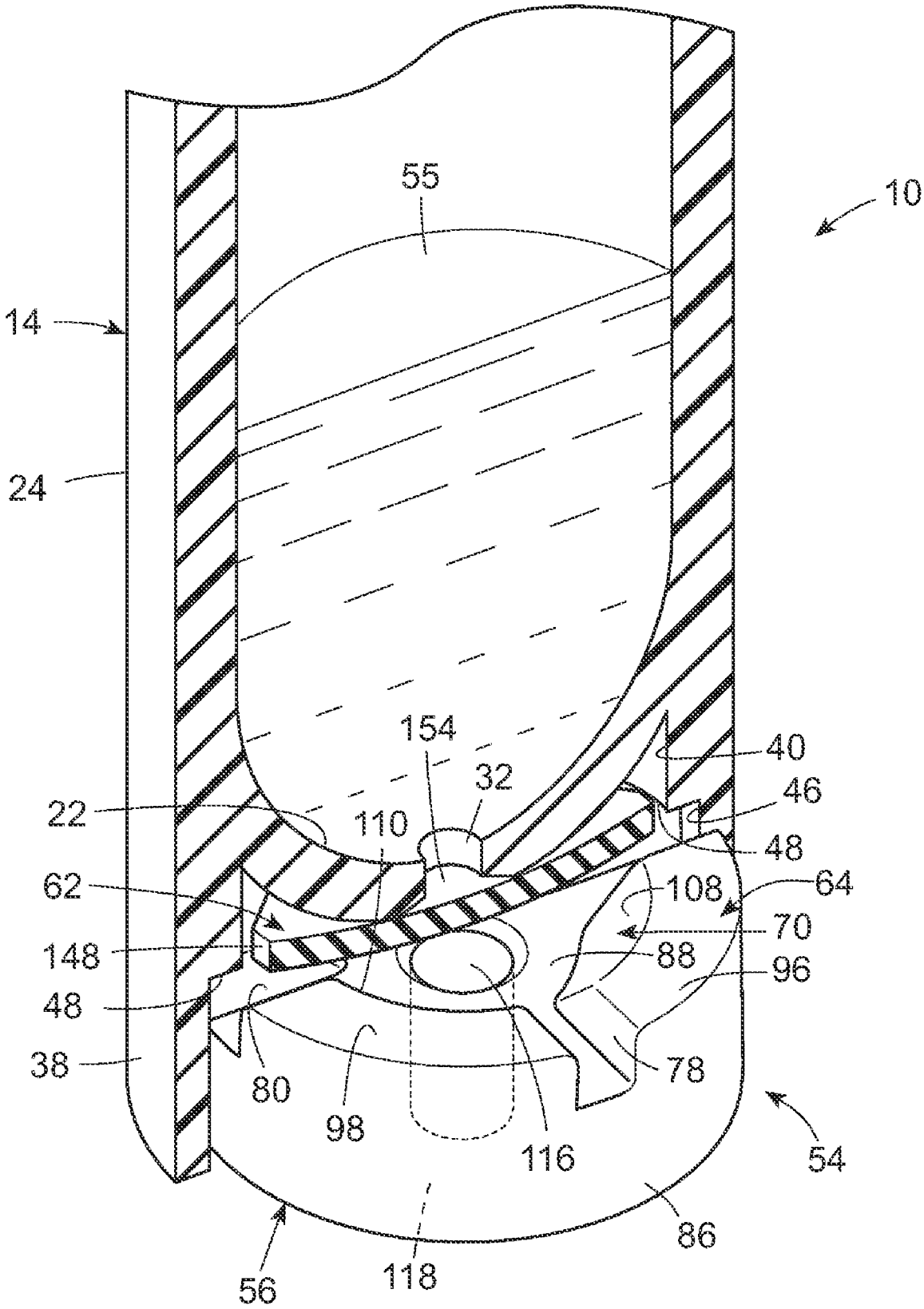
FIG. 4 is an enlarged fragmentary perspective view thereof, partly shown in section.

The non-movable member 56 can be formed of a suitable plastic such as polystyrene and is non-movable relative to the vessel portion 14 and has a generally frusto-conical recess 70 (FIGS. 4 and 6) in the top end 64. Four channels 74, 76, 78 and 80 (FIGS. 3 and 6) are formed in the top end 64 of the non-movable member 56 and extend radially from an outer cylindrical surface 86 (FIGS. 4 and 6) of the non-movable member 56 into the frusto-conical recess 70. The channels 74, 76, 78, and 80 and the frusto-conical recess 70 have a common floor surface 88. The top end 64 of the non-movable member 56 is thus divided into four segmental surface portions 94, 96, 98 and 100 (FIGS. 3, 4 and 6).

Figure 6:
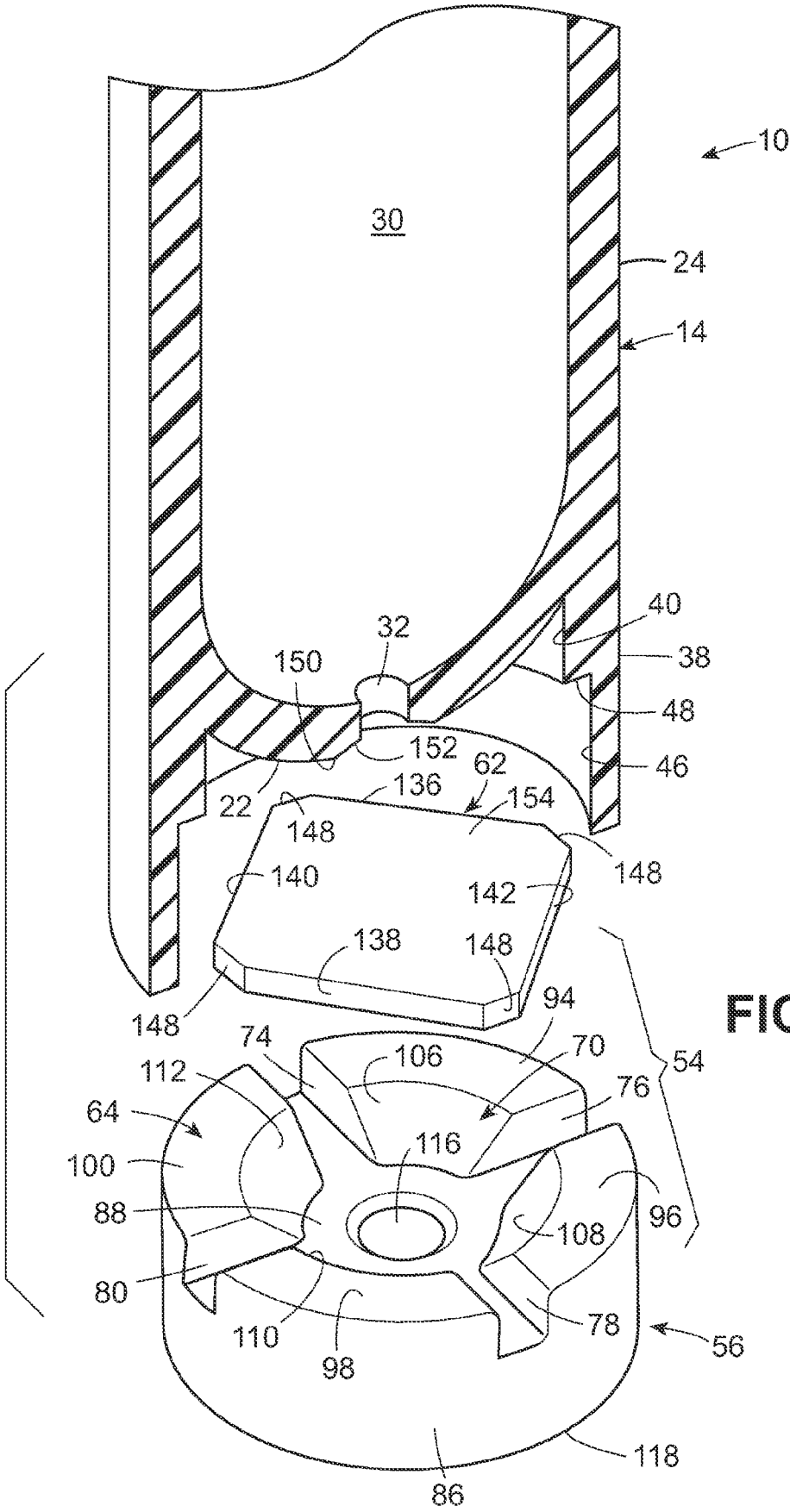
FIG. 6 is an enlarged fragmentary exploded view thereof, partly shown in section.

The intersections between the frusto-conical recess 70, and the channels 74, 76, 78 and 80 define frusto-conical segments 106, 108, 110 and 112 (FIG. 6).

A valve opening 116 is formed in the non-movable member 56 co-axial with the bottom opening 32 of the vessel portion 14. The valve opening 116 extends from the floor surface 88 to a bottom surface 118 of the non-movable member 56.

The valve opening 116 is counter-sunk at the floor surface 88 and is surrounded by an annular channel 124 at the bottom surface 118 of the non-movable member 56. The annular channel 124 includes a frusto-conical side wall 126 (FIG. 5) and a generally cylindrical side wall 132 (FIG. 5) that is concentric with the outer cylindrical surface 86 (FIG. 4) of the non-movable member 56.

The membrane 62, (FIGS. 3 and 6), which is supported on the segmental surface portions 94, 96, 98 and 100 of the non-movable member 56, has a generally square perimeter with opposite sides 136, 138 and 140, 142 of equal length, and corners 148 that are chamfered.

The distance between opposite diametrical corners 148 of the membrane 62 is less than the diameter of the first cylindrical surface portion 40 of the annular collar 38 to provide clearance between the generally square perimeter of the membrane 62 and the first cylindrical surface portion 40 for any orientation of the membrane 62 on the segmental surface portions 94, 96, 98 and 100.

The diameter of the outer cylindrical surface 86 of the non-movable member 56 is slightly less than the diameter of the second cylindrical surface portion 46 of the annular collar 38, but greater than the diameter of the first cylindrical surface portion 40 of the annular collar 38.

The non-movable member 56 is thus receivable in the annular collar 38 such that the top end 64 abuts against the annular step 48.

The valve 54 can be installed in the annular collar 38 by turning the vessel portion 14 upside-down and initially placing the membrane 62 within the confines of the first cylindrical surface portion 40. The corners 148 help to self-center the membrane within the confines of the first cylindrical surface portion 40. The non-movable member 56 is then pushed into the annular collar 38 until the segmental surface portions 94, 96, 98 and 100 abut against the annular step 48.

If desired an adhesive such as a suitable known UV curing adhesive can be used to bond the outer cylindrical surface 86 of the non-movable member 56 to the second cylindrical surface portion 46.

Under this arrangement, the deflectable membrane 62 is supported on the segmental surface portions 94, 96, 98 and 100 of the non-movable member 56, with the membrane 62 being pressed against the opening 32. The membrane 62 thus closes the opening 32, characterizing a closed condition of the valve 54, also referred to as a valve-closed condition.

Such closure of the bottom opening 32 by the membrane 62 is accomplished by rendering the membrane 62 thicker than the distance between the segmental surface portions 94, 96, 98 and 100, and a lowermost portion 150 (FIG. 6) of the vessel 14. The lowermost portion 150 of the vessel 14 surrounds a countersunk portion 152 (FIG. 6) of the bottom opening 32. For example, the distance between the segmental surface portions 94, 96, 98 and 100 and the lowermost portion 150 of the vessel 14 can be approximately 0.17 millimeters and the thickness of the membrane 62 can be approximately 0.5 millimeters.

Referring to FIG. 1, a pressurizing device 160 is provided at the open end 16 of the vessel portion 14. The pressurizing device 160 includes a pressure tube 168 extending from any suitable known pressure source (not shown). An end 170 of the pressure tube 168 is disposed in a cap-like sealing device 176 that is held against the open end 16 of the vessel portion 14 in a known manner to form a leak-tight seal around the open end 16.

Pressure is applied to the pressure tube 168 in a known manner for a predetermined time to exert a predetermined pressure on the liquid 55 in the liquid receiving space 30 of the vessel portion 14.

Pressure imposed on the liquid 55 by the pressurizing device 160 causes the liquid 55 to exert pressure on the membrane 62 through the bottom opening 32. Pressure on the membrane 62 causes the membrane 62 to deflect away from the bottom opening 32. When the membrane 62 is deflected away from the bottom opening 32 liquid 55 within the liquid receiving space 30 can flow outwardly of the bottom opening 32. The membrane 62 thus uncovers the opening 32, characterizing an open condition of the valve 54, also referred to as a valve-open condition.

Figure 5:
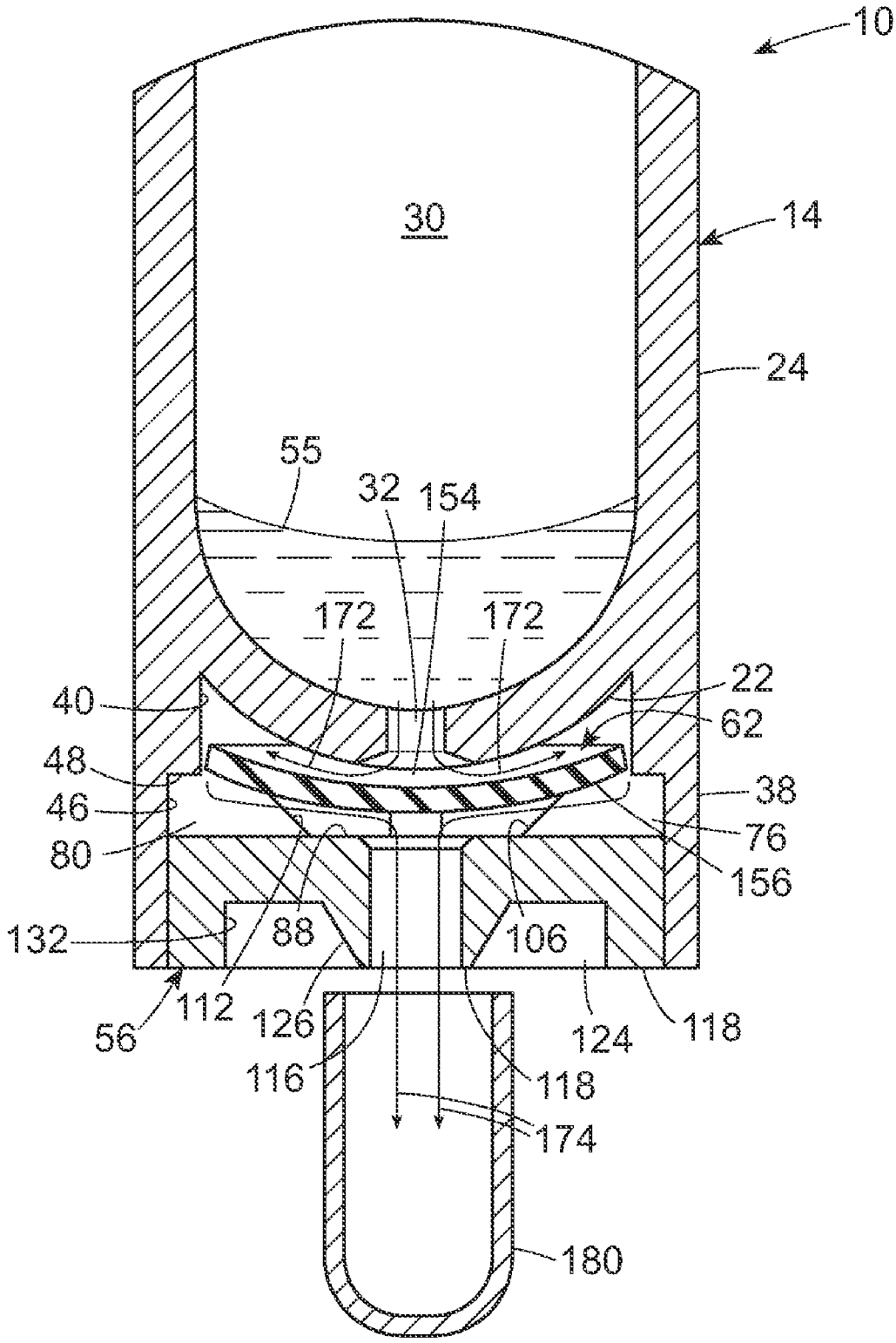
FIG. 5 is a sectional view thereof, similar to FIG. 2, wherein the control valve is in an open condition.

As most clearly shown in FIG. 5, the liquid 55 flowing outwardly of the bottom opening 32 follows the path of the arrows 172 across the upper surface 154 of the membrane 62 toward the first cylindrical surface portion 40 and around the side edges 136, 138, 140, 142 and the corners 148 of the membrane 62. The liquid 55 can also flow (FIG. 3) into the channels 74, 76, 78 and 80 and into the frusto-conical recess 70, as generally indicated by the arrows 174 in FIG. 5. The liquid 55 thus flows below the lower surface 156 of the membrane 62 and into the valve opening 116 which serves as an outlet port of the sample preparation device 10.

The liquid 55 that flows outwardly of the valve opening 116 can be collected in a collection cup 180 (FIG. 5) or any other suitable liquid collection device.

The valve 54 is restored to its valve-closed condition when pressure in the pressure-tube 168 is reduced to a predetermined level that enables the membrane 62 to reassume its non-deflected or closed position against the bottom opening 32. Thus when the valve 54 is in its valve-closed position, liquid 55 cannot flow outwardly of the bottom opening 32 of the vessel portion 14.

Under this arrangement the liquid 55 is dispensed or evacuated from the vessel portion 14 into the collection cup 180 without introducing any liquid removal devices into the liquid receiving space 30 of the vessel portion 14. Since there is no physical contact between a liquid-removal device and the liquid 55 in the vessel portion 14 there is substantially no problem of liquid carryover when the sample preparation device 10 dispenses liquid 55 through the outlet port 116.

The size of the collection vessel 180 for receiving dispensed liquid 55 is usually based upon the amount of liquid 55 being evacuated from the vessel 14 during a valve-open cycle.

Although the preferred embodiment of this invention is a sample-preparation device, the invention is applicable to other types of vessels with liquid-receiving spaces, where it may be desirable to remove liquid without physical contact between a liquid removal device and the liquid being dispensed.

As various changes can be made in the above constructions and methods without departing from the scope of the invention, it is intended that all matter contained in the above description or shown in the accompanying drawings shall be interpreted as illustrative and not in a limiting sense.

What is claimed is:

1. A sample preparation device comprising, (a) a vessel having a liquid receiving space and a bottom end defining a bottom portion of the liquid receiving space, (b) the bottom end of the vessel having a bottom opening, (c) a valve at the bottom end of the vessel below said bottom opening for controlling the flow of any liquid in said liquid receiving space out of said liquid receiving space through said bottom opening, said valve having an outlet port communicable with the bottom opening to enable any liquid flowing through the bottom opening to flow to said outlet port, (d) said valve being in a normally closed condition for preventing any liquid in said vessel from flowing out of said liquid receiving space through said bottom opening, and (e) said valve having a deflectable membrane positioned against the bottom end of said vessel and against said bottom opening to close said bottom opening when said valve is in its normally closed condition, said membrane being deflectable away from the bottom end of said vessel and away from the bottom opening such that the membrane is spaced from said bottom opening when said valve is in said open condition to permit any liquid in said liquid receiving space to flow through said bottom opening and through the space between said membrane and said bottom opening to said outlet port.

2. The sample preparation device as claimed in claim 1 wherein the deflectable membrane is positioned outside said liquid receiving space against said bottom opening when said valve is in its normally closed condition.

3. The sample preparation device as claimed in claim 1 wherein the valve includes a non-movable member relative to the vessel provided at the bottom end of said vessel outside said liquid receiving space and said deflectable membrane is located between said non-movable member and the bottom end of said vessel.

4. The sample preparation device as claimed in claim 3 wherein the non-movable member includes a recess into which the membrane deflects when the valve is in said open condition.

5. The sample preparation device as claimed in claim 4 wherein the recess communicates with said bottom opening and said outlet port to permit any liquid in said vessel to flow into said recess from said bottom opening, and into said outlet port from said recess, when said valve is in said open condition.

6. The sample preparation device as claimed in claim 4 wherein the non-movable member includes at least one channel in communication with said bottom opening and said recess such that any liquid in said vessel that flows through said bottom opening when said valve is in said open condition can flow through said one channel, into said recess and through said outlet port.

7. The sample preparation device as claimed in claim 4 wherein said non-movable member has a support surface bordering said recess for supporting said deflectable membrane against said bottom opening to close off said bottom opening when said valve is in said closed condition.

8. The sample preparation device as claimed in claim 3 wherein the non-movable member has a support surface for supporting said deflectable membrane against said bottom opening to close off said bottom opening when said valve is in said closed condition, and at least one channel is formed in said support surface for communication with said bottom opening when said valve is in said open condition, such that any liquid in said vessel that flows through said bottom opening when said valve is in said open condition can flow through said one channel, into said recess and through said outlet port.

9. The sample preparation device as claimed in claim 1 further including a collar portion extending beyond the bottom end of the vessel for accommodating said valve.

10. The sample preparation device as claimed in claim 9 wherein the valve includes a non-movable member relative to the vessel provided at the bottom end of said vessel outside said liquid receiving space and immovably held within said collar portion.

11. The sample preparation device as claimed in claim 10 wherein the deflectable membrane is positioned between the non-movable member and the bottom opening.

12. The sample preparation device as claimed in claim 11 wherein the non-movable member includes a recess into which the membrane deflects when the valve is in said open condition.

13. The sample preparation device as claimed in claim 12 wherein the recess communicates with said bottom opening and said outlet port to permit any liquid in said vessel to flow into said recess from said bottom opening, and into said outlet port from said recess, when said valve is in said open condition.

14. The sample preparation device as claimed in claim 12 wherein the non-movable member includes at least one channel in communication with said bottom opening and said recess such that any liquid in said vessel that flows through said bottom opening when said valve is in said open condition can flow through said one channel, into said recess and through said outlet port.

15. The sample preparation device as claimed in claim 12 wherein said non-movable member has a support surface bordering said recess for supporting said deflectable membrane against said bottom opening to close off said bottom opening when said valve is in said closed condition.

16. The sample preparation device as claimed in claim 10 wherein the non-movable member has a support surface for supporting said deflectable membrane against said bottom opening to close off said bottom opening when said valve is in said closed condition, and at least one channel is formed in said support surface for communication with said bottom opening when said valve is in said open condition, such that any liquid in said vessel that flows through said bottom opening when said valve is in said open condition can flow through said one channel, into said recess and through said outlet port.

17. The sample preparation device as claimed in claim 16 wherein said collar has an inner surface with a first diametrical magnitude portion and said channel extends to at least the inner surface of said collar and said deflectable membrane is located within the first diametrical magnitude portion of said collar, said deflectable membrane having a maximum diametrical magnitude that is less than the first diametrical magnitude portion of said collar by a predetermined amount to permit liquid to flow between the edge of said membrane and the inner surface of said collar into said channel, into said recess and through said outlet port when said valve is in said open condition.

18. The sample preparation device as claimed in claim 1 wherein the vessel is tubular.

19. A method of dispensing liquid from a vessel comprising, (a) providing a vessel with a liquid receiving space and a bottom end defining a bottom portion of the liquid receiving space, (b) providing a bottom opening at the bottom end of the vessel, (c) locating a valve at the bottom end of the vessel below said bottom opening to control the flow of any liquid out of the liquid receiving space through the bottom opening, such that when the valve is in an open condition liquid can flow out of the vessel through the bottom opening and when the valve is in a closed condition liquid cannot flow out of the vessel through the bottom opening, (d) providing the valve with an outlet port communicable with the bottom opening to enable any liquid flowing through the bottom opening to flow to said outlet port, (e) positioning a deflectable membrane in the valve below the bottom opening such that the membrane has a normally closed position against the bottom end of said vessel and against the bottom opening to close off the bottom opening when the valve is in a closed condition, (f) applying pressure on the deflectable membrane through the liquid receiving space and the bottom opening to deflect the membrane away from the bottom end of the vessel and away from the bottom opening such that the membrane is spaced from the bottom opening when the valve is placed in an open condition.

20. The method of claim 19 including providing for a liquid flow path to be established from the bottom opening, around the membrane and into the outlet port when the membrane is deflected away from the bottom end and away from the bottom opening to place the valve in the open condition.

* * * * *